US005100055A

United States Patent [19]

Rokitenetz, deceased et al.

[11] Patent Number: 5,100,055

[45] Date of Patent: Mar. 31, 1992

[54] SPRAY VALVE WITH CONSTANT ACTUATING FORCE

[75] Inventors: Walter Rokitenetz, deceased, late of Granada Hills, by Brian R. Rokitenetz, executor; Benjamin H. Stansbury, Jr., Beverly Hills, both of Calif.

[73] Assignee: Modern Faucet Mfg. Co., Los Angeles, Calif.

[21] Appl. No.: 407,571

[22] Filed: Sep. 15, 1989

[51] Int. Cl.[5] ..... B05B 1/18; B05B 1/34

[52] U.S. Cl. ..... 239/11; 239/436; 239/443; 239/468; 239/525; 239/583; 251/172; 251/340

[58] Field of Search ..... 239/436, 437, 443, 444, 239/445–449, 457, 460, 463, 468, 569, 583, 525, 526, 11; 137/219; 251/340, 354, 172

[56] References Cited

U.S. PATENT DOCUMENTS

| | | | |
|---|---|---|---|
| 650,295 | 5/1900 | Boulard | 251/340 |
| 2,126,856 | 8/1938 | Yancey | 251/340 |
| 2,369,356 | 2/1945 | Koehn | 251/340 |
| 2,457,993 | 1/1949 | Fletcher et al. | 239/583 |
| 3,588,040 | 6/1971 | Ward . | |
| 4,187,986 | 2/1980 | Petrovic . | |
| 4,398,669 | 8/1983 | Fienhold | 239/447 |
| 4,589,439 | 5/1986 | Steingass | 137/219 |
| 4,650,120 | 3/1987 | Kress | 239/446 |
| 4,754,928 | 7/1988 | Rogers et al. | 239/447 |

FOREIGN PATENT DOCUMENTS

| | | | |
|---|---|---|---|
| 971363 | 11/1982 | U.S.S.R. | 239/583 |

*Primary Examiner*—Andres Kashnikow
*Assistant Examiner*—Christopher G. Trainor
*Attorney, Agent, or Firm*—Lackenbach Siegel Marzullo & Aronson

[57] ABSTRACT

A spray valve is disclosed for controlling and directing the flow of a fluid. The spray valve includes an integral trigger/waterway, that is movable between an open and a closed position, and a non-movable fluid seal that plugs the end of the waterway to prevent the flow of fluid. A spring normally biases the trigger to the closed position. The force needed to activate the trigger is substantially independent of the water pressure flow and is defined almost exclusively by the force needed to compress the spring. The spray valve assembly is held together by an integral snap-fit construction, eliminating the need for fasteners such as screws, pins, or the like. The spray valve includes a spray cap that provides a variety of spray patterns. At least one of the bores in the spray cap which is used to produce a coarse spray is also used to produce a mist, so that a conventional bore having a relatively small diameter for producing a mist is not required and the likelihood of clogging is reduced.

13 Claims, 6 Drawing Sheets

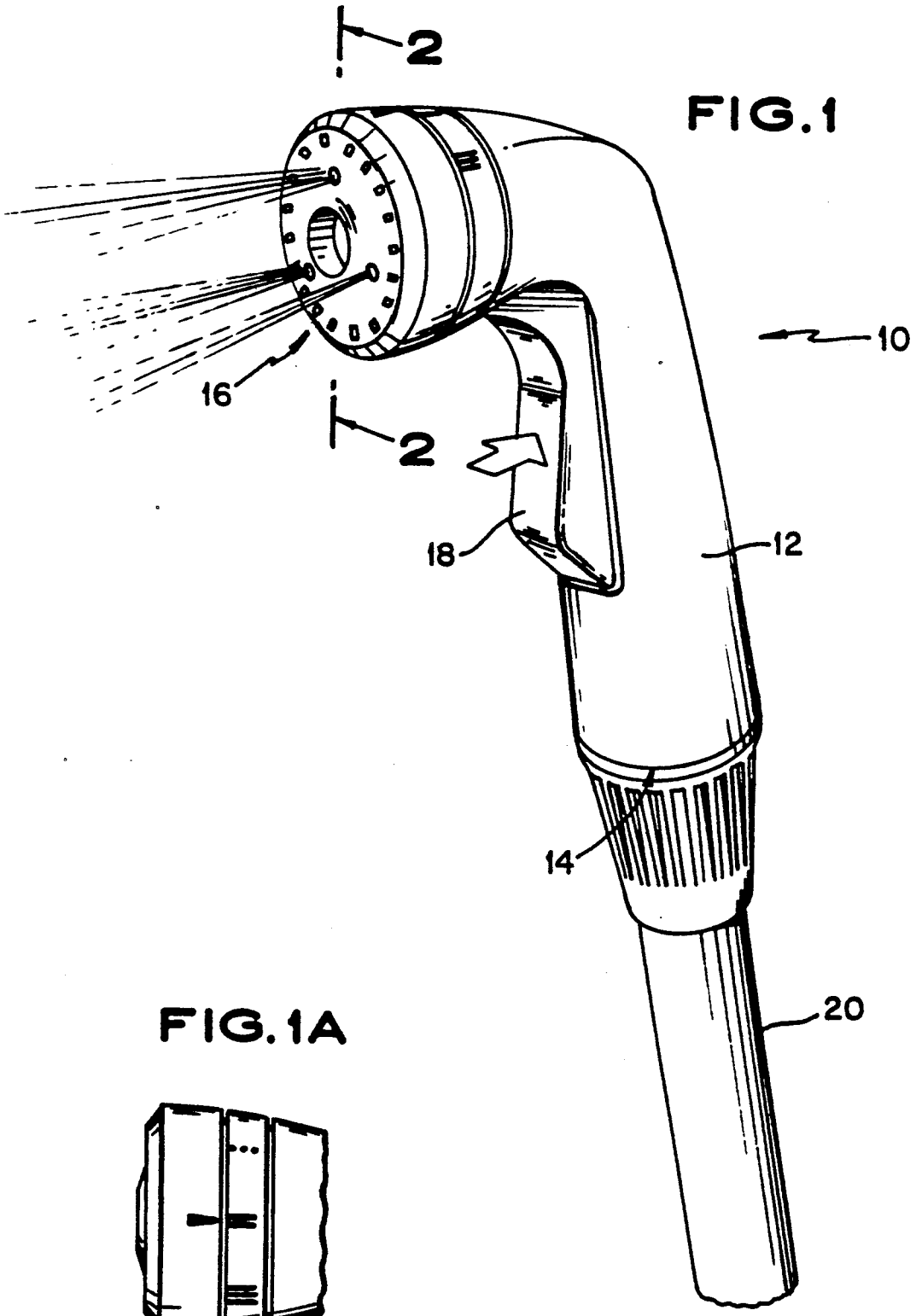
FIG.1A
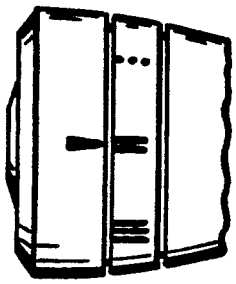

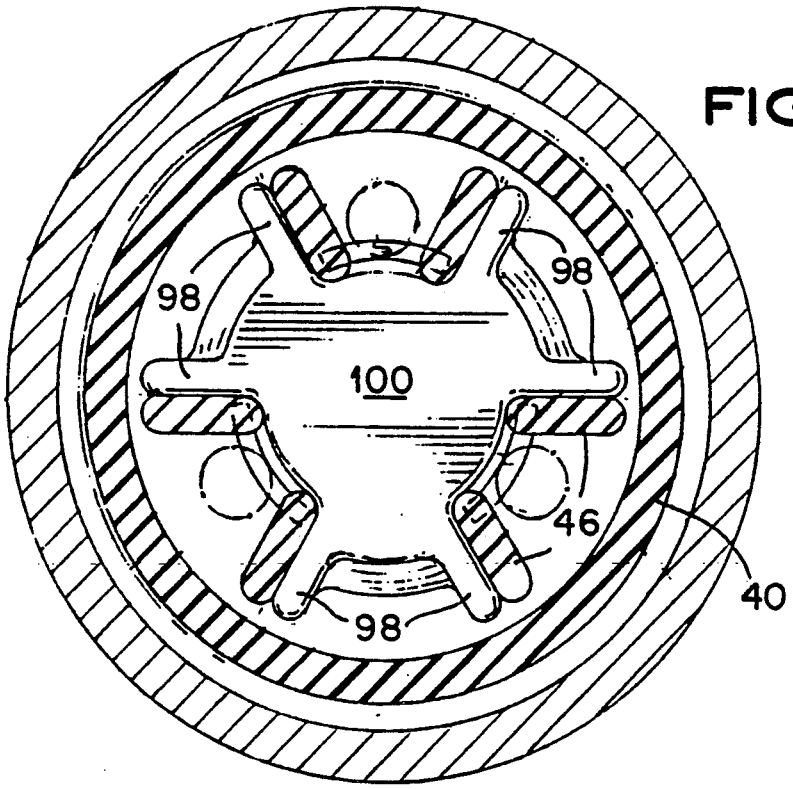
FIG.8
FIG.9
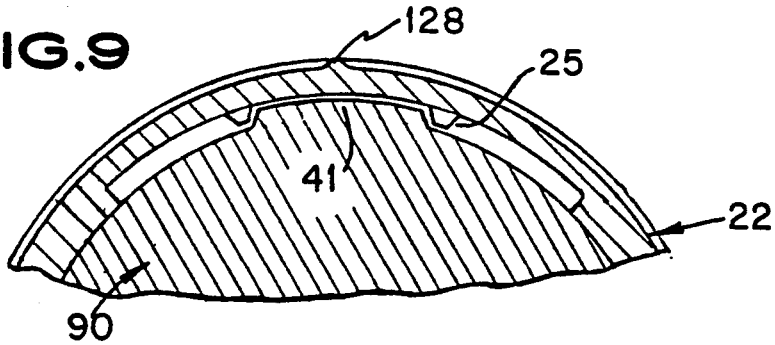
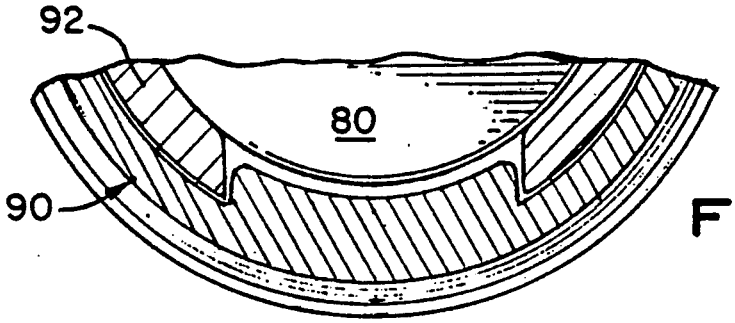
FIG.10

SPRAY VALVE WITH CONSTANT ACTUATING FORCE

BACKGROUND OF THE INVENTION

1. Field of the Invention

This invention relates to spray valves and, more particularly, to a trigger actuated spray valve having a constant trigger actuating force regardless of fluid pressure and having a relatively simple and inexpensive construction for easy assembly.

2. Description of the Related Art

Many different types of spray valves are used for watering, dishwashing, vegetable spraying, and plant misting. Such spray valves are also used with shower heads for bathing. Typical spray valves are described in U.S. Pat. No. 3,588,040 and U.S. Pat. No. 4,187,986. As can be seen from these patents, such devices involve many parts and require careful assembly. These spray valves include a housing with an integral hollow waterway directing the flow of fluid from a valve inlet port to a valve outlet port. The valves operate by having a plunger or stem that fits into the waterway and seats against a rim inside the waterway, thereby plugging the waterway and blocking the flow of fluid. The plunger is actuated by a lever or knob located outside the waterway, the lever or knob being operated by the thumb of the user.

The plungers of these spray valves include a flexible, generally circular gasket placed on the plunger and in the waterway. When the plunger is seated in the waterway, the gasket is clamped against the internal rim, thereby stopping the flow of fluid. When the plunger is moved away from the waterway rim, fluid can flow past the gasket and toward the outlet port. A spring is used to bias the plunger into a normally closed position. A second gasket is provided to seal off the plunger and waterway from the trigger-actuating knob or lever. This gasket prevents the leakage of fluid around the plunger and out the knob. Fluid is not allowed to flow around this gasket regardless of the movement of the knob. During assembly, the moving parts, springs, gaskets and the like must be carefully positioned or the finished product will leak. Thus, the construction, manufacture, and assembly of these spray valves involves many parts and is quite complicated.

In starting and stopping fluid flow, the plunger operates by plugging or unplugging the waterway and therefore presents a surface normal to the flow of water. Thus, the plunger either works with or against the flow when moving from the stopped to open position. Therefore, the force needed to actuate the plunger varies with the flow pressure of the fluid. For spray valves that are used in conjunction with household plumbing, standardized testing procedures require testing of valve operation at water pressures of 20 psi and 125 psi.

Testing has shown that the force required to actuate the spray valve embodied in U.S. Pat. No. 3,588,040 varies from approximately 3 lbs. at 20 psi to approximately 7½ lbs. at 125 psi. The spray valve embodied in U.S. Pat. No. 4,187,986 has an actuating pressure that varies from approximately 7½ lbs. at 20 psi to approximately 3 lbs. at 125 psi. This is a large variation in the thumb pressure required for operation. Persons suffering from arthritis or from decreased hand strength find it difficult or impossible to operate the valves at the higher actuating pressures. It is desirable to provide a spray valve with a constant, moderate actuating pressure.

It is also desirable to provide a spray valve with multiple spray patterns. For example, these multiple spray patterns may include a coarse spray, a fine spray, and a mist spray. A multiple pattern spray valve is described in the above-referenced U.S. Pat. No. 4,187,986. This spray valve, however, achieves its multiple pattern sprays through a rather complex mechanism having a rotating and reciprocating plunger stem and a series of plates with many irregular surfaces. An innermost plate is provided with a plurality of orifices and projecting nubs, and is attached to the plunger stem. A second seal plate is provided with a plurality of openings. The innermost plate is rotated by a knob that is connected to the plate by a shaft passing through the housing, with the nubs seating in all of the openings except a set corresponding to a particular spray pattern. An outermost spray plate contains passages that communicate with the seal plate openings, different passages communicating with different sets of openings to provide the desired spray patterns. This construction is overly complex.

SUMMARY OF THE INVENTION

The present invention provides a spray valve whose actuating force remains constant regardless of the water pressure. The present invention accomplishes this by providing an actuating trigger that includes an integral waterway. The trigger/waterway is pressed against a seal in order to shut off water flow, and is lifted away from the seal in order to enable water flow. The trigger is biased to a normally closed position. The seal surface against which the waterway is pressed does not move with the trigger. The trigger itself presents virtually no surface area perpendicular to the fluid flow and therefore does not have to work against the fluid pressure. Thus, the trigger actuating force is substantially constant regardless of the fluid pressure, and the biasing force and the friction of the trigger seals are substantially the only forces that must be overcome when operating the trigger. The constant actuating force makes the valve easier and more comfortable to use.

The spray valve may include a spray cap that provides a multi-pattern spray allowing the selection of, for example, a coarse spray (e.g., jet), a fine spray, or a mist setting. The spray cap includes a plurality of orifices defining the spray patterns. The various spray patterns are selected by positioning the spray cap and a selector plate that move relative to each other. The selector plate includes a plurality of openings, or orifices. When the orifices of the selector plate are aligned with a given set of orifices in the spray cap, fluid can flow only through the selected orifices in the spray cap. Thus, the valve produces the desired spray pattern.

A described embodiment of the spray valve has only two sets of orifices, yet allows a user to select from three different spray patterns. The same orifice which is used to generate a coarse spray is also used to generate a mist. That is, at least one of the relatively large bores which are used to produce jets of fluid is also used to produce a fine mist. Thus, the likelihood of clogging is reduced due to the relatively large size of the bore.

The spray valve is also of a simplified construction that is easier to manufacture and assemble than previous valves. The spray valve may be constructed such that the operating parts are held together by means of a snap-fit construction. Thus, no screws or bolts and no fastening tools are necessary for assembly. The parts are simply snapped together, piece by piece. This reduces the cost of materials and reduces assembly time, and reduces in-store vandalism of parts.

In accordance with the illustrated preferred embodiment of the present invention, the valve trigger is operated by the fingers of the user's hand rather than by the thumb, and the valve body is cradled between the thumb and forefinger. Along with the constant actuating force, this makes the spray valve easier and more comfortable to use.

BRIEF DESCRIPTION OF DRAWINGS

The present invention will be described with reference to the appended drawings wherein:

FIGS. 1 and 1A are perspective view and a fragmentary view of a spray valve in accordance with a preferred embodiment of the present invention;

FIG. 8 is a view of the selector seal taken along the lines shown in FIG. 2;

FIG. 9 is a view of the preferred embodiment taken along the lines shown in FIG. 2; and FIG. 10 is a view of the preferred embodiment taken along the lines shown in FIG. 2.

DETAILED DESCRIPTION OF THE DRAWINGS

Figure 2:
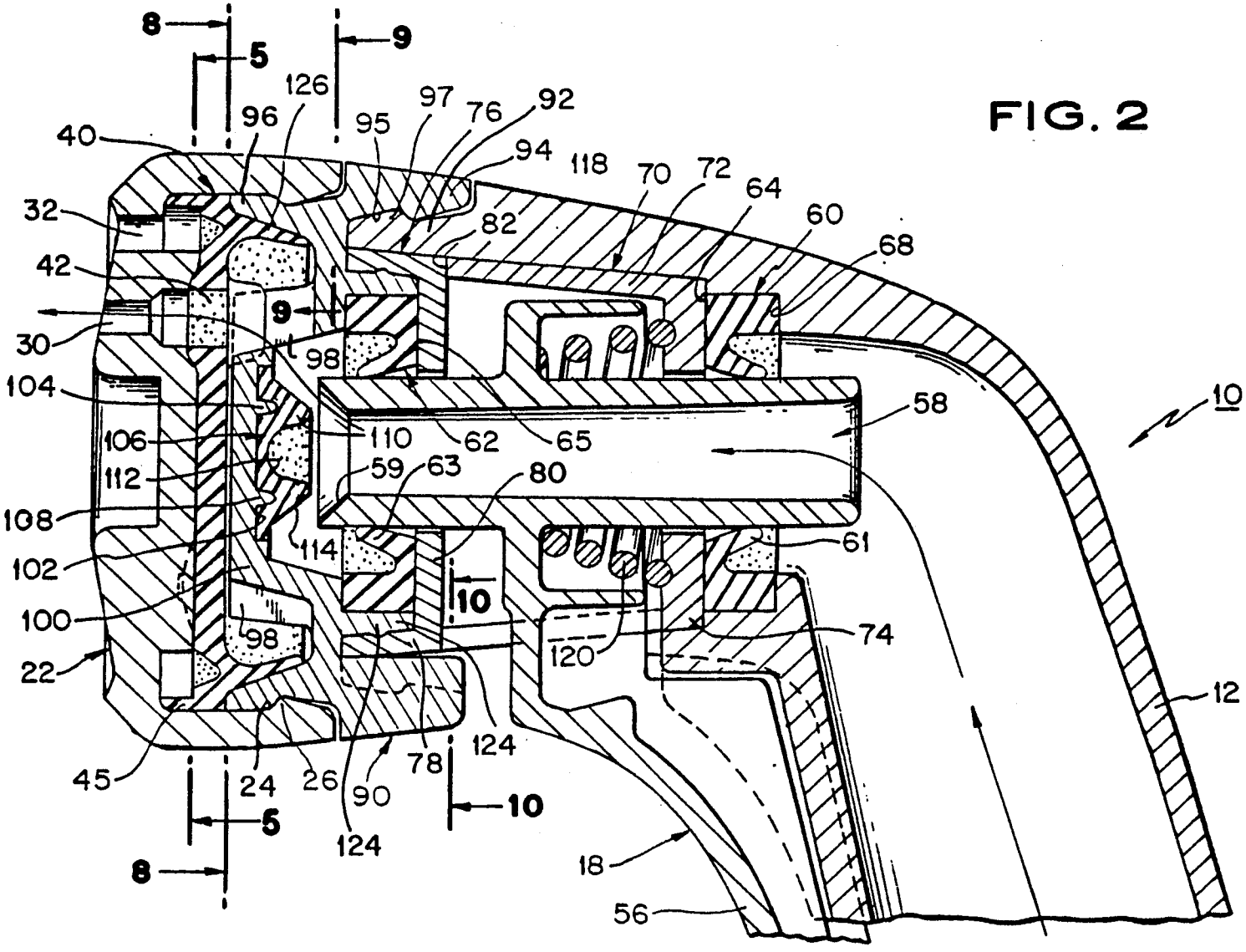
FIG. 2 is a cutaway view of the assembled spray valve of the present invention in the open or fluid passing position.

The following description is of the best presently contemplated mode of carrying out the invention. This description is made for the purpose of illustrating the general principles of the invention and is not to be taken in a limiting sense. The scope of the invention is best determined by reference to the appended claims and equivalents thereof.

FIG. 1 shows a perspective view of a spray valve 10 in accordance with the present invention. The spray valve 10 comprises a body portion 12 with an inlet opening 14 at one end and a spray outlet opening 16 at the other end. The spray valve 10 includes a trigger 18 for controlling the on-off operation of the valve 10. To operate the valve 10, the trigger 18 is moved in the direction of the arrow A. A hose 20 is attached to the spray valve 10 at the inlet opening 14. Water or other fluid is directed through the hose 20, into the inlet opening 14, through the waterway, and out the spray outlet opening 16.

Figure 3:
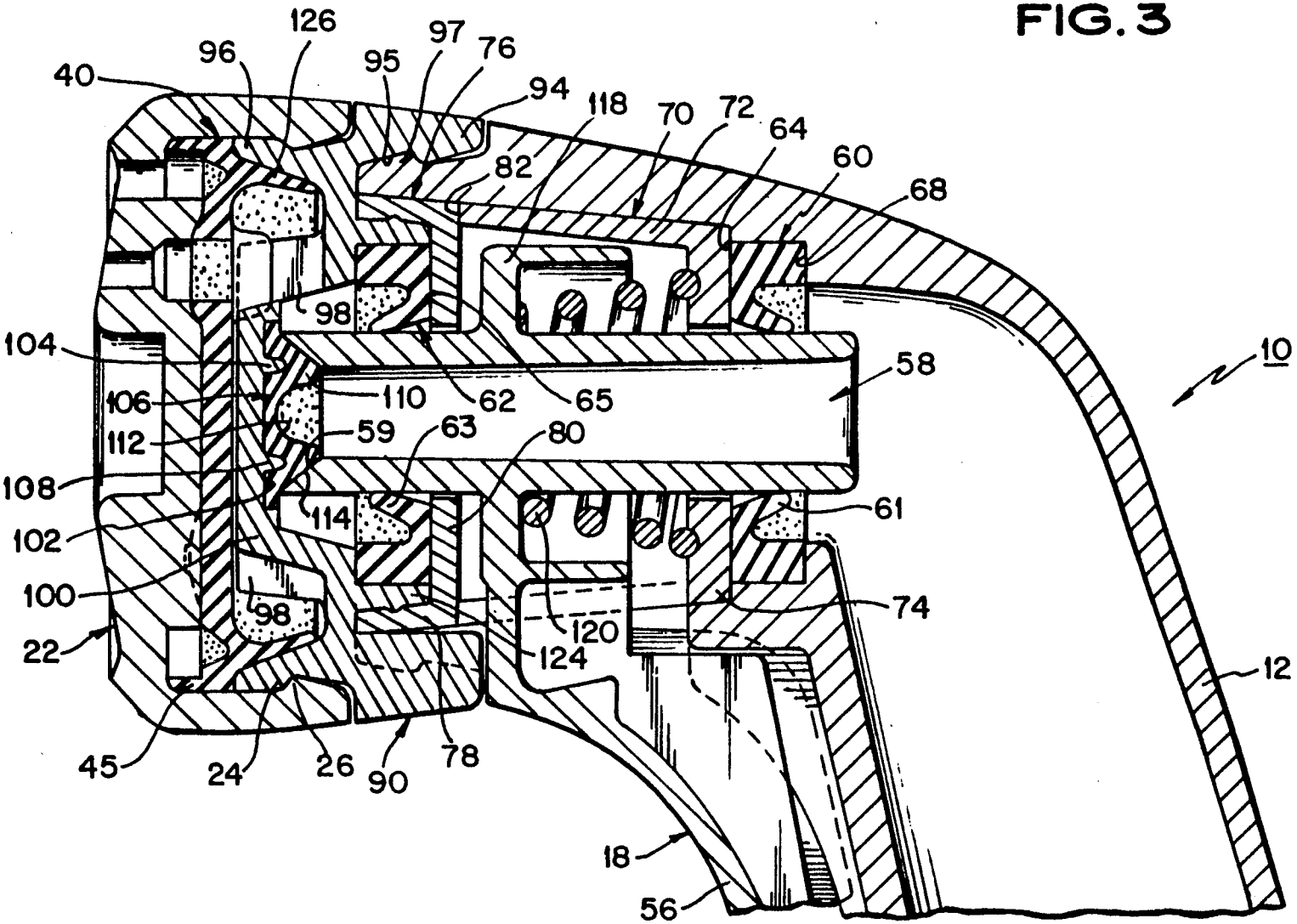
FIG. 3 is a cutaway view of the assembled spray valve of the present invention in a closed or fluid blocking condition.
Figure 4:
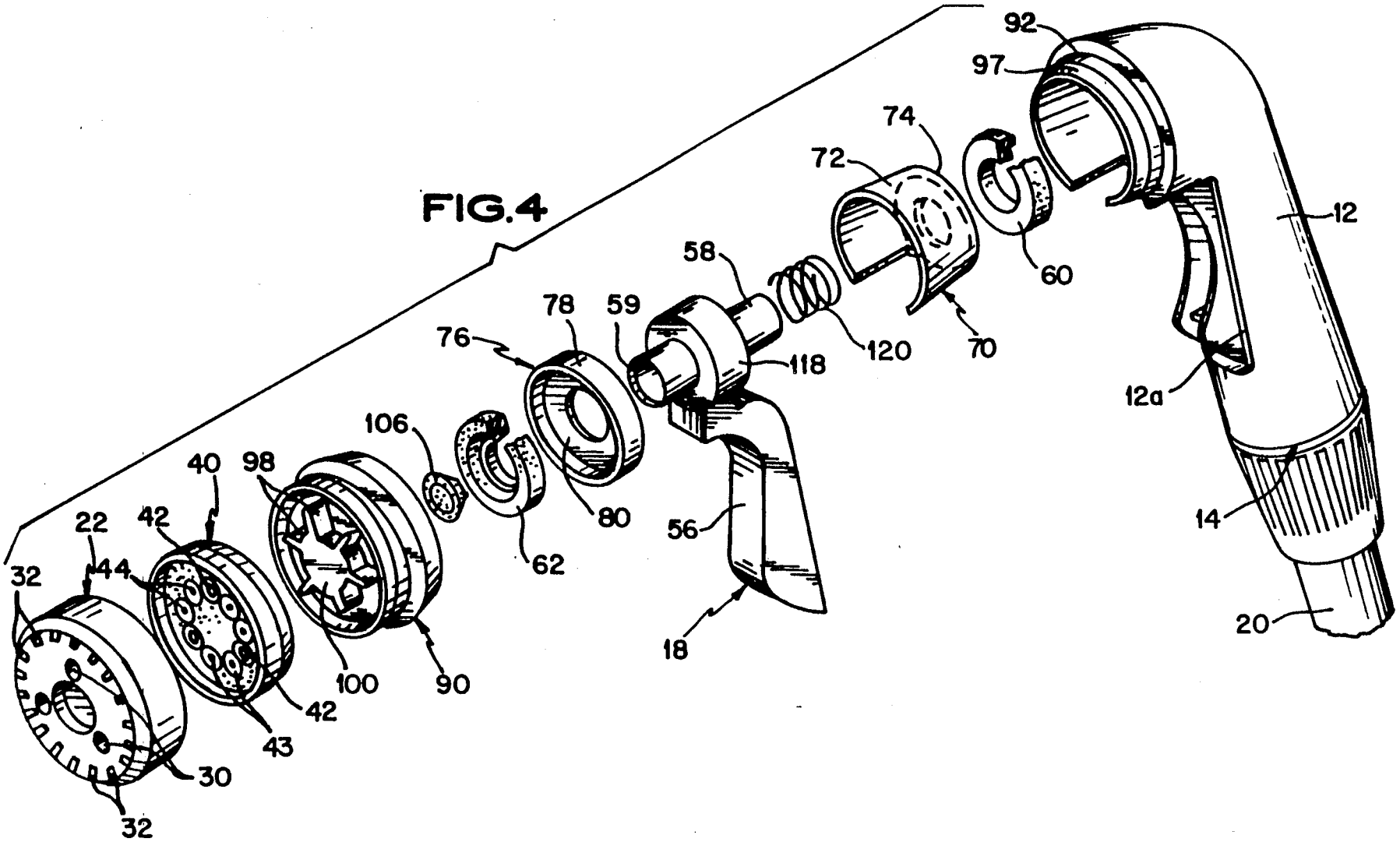
FIG. 4 is an exploded perspective view of a spray valve in accordance with a preferred embodiment of the present invention.

An internal view of a presently preferred embodiment of the present invention is shown in FIGS. 2 and 3. FIG. 2 shows the valve 10 in an open position and FIG. 3 shows the valve 10 in a closed position. FIG. 4 shows an exploded perspective view of the valve 10.

The trigger 18 slides into a recess **12*a* in the body portion 12. The trigger 18 includes a curved handle portion 56 and a cylindrical body portion 58 defining a waterway, which is open at both ends. The fluid flow within the body 12 travels through the waterway of the cylindrical body 58 from an end near the valve inlet opening 14 to an end near the spray outlet opening 16. The rim of the waterway outlet end has a beveled edge 59** that slants diagonally from the exterior of the waterway inwardly toward the center of the waterway.

Two identical ring-shaped seals, a rear seal 60 and a front seal 62, are provided to prevent leakage of fluid at the inlet and outlet ends, respectively, of the waterway. Each of the seals 60 and 62 has a body portion and a raised lip 61 and 63, respectively, extending toward the axial center of the seal from a flat bottom surface 64 and 65, respectively. The diameter of the seals 60, 62 is such that each seal 60, 62 slides over the cylindrical body portion 58 of the trigger 18, with each seal lip 61, 63 pressing against the cylindrical body 58. An annular channel is formed by the seal lip and the seal body. Each seal 60, 62 is oriented so that fluid pressure in the valve body will fill the annular channel, thereby pressing the seal lip 61, 63, respectively, against the outer surface of the cylindrical body 58 and thereby providing a better seal.

The rear seal 60 fits into a space in the body portion 12 formed by a ledge having a seat surface 68. The rear seal 60 is held in place against the ledge by a cup-shaped rear seal retainer 70. In this way, when the trigger 18 is actuated, or reciprocated, the rear seal 60 does not reciprocate with the trigger 18. The rear seal retainer 70 has a cup side wall 72 and a central hole in the cup bottom 74, the central hole having a diameter slightly larger than the outer diameter of the trigger cylindrical body 58. The cup bottom wall 74 seats against the flat bottom surface 64 of the rear seal 60, thereby holding the rear seal 60 in place while the trigger 18 is reciprocated.

A cup-shaped front seal retainer 76 includes a raised sidewall 78 and a flat cup bottom wall 80. The bottom wall 80 of the front seal retainer 76 seats against the top rim 82 of the rear seal retainer 70. The front seal retainer 76 also has a central hole in the cup bottom wall 80 with a diameter slightly larger than the outer diameter of the trigger cylindrical body 58. The front seal retainer 76 receives the front seal 62 in the interior of its cup, the front seal flat bottom surface 63 resting on the front seal cup bottom wall 80.

An on-off seal mount 90 snaps into position against the body portion 12, thereby becoming an integral part of the body 12, and also snaps against the front seal retainer 76. The on-off seal mount 90 is a generally circular disk with opposing circumferential rims 94 and 96 extending from the circumference of the seal mount 90. The body portion rim 94 extends toward the body portion 12, while the cap rim 96 extends away from the body portion 12. The center of the on-off seal mount 90 includes a cylindrical ridge 124 extending in the same direction as the rim 94. Rising from the center of the on-off seal mount 90 to a seal support 100 are extending fingers 98. The seal support 100 is a raised, generally circular disc having an interior surface 102 that faces the waterway of the cylindrical body portion 58 of the trigger 18.

The body portion 12 of the valve 10 includes a raised shoulder 92 around the circumference of the outlet opening, with a ridge 97 extending from the outer surface of the shoulder 92. The body portion rim 94 of the on-off seal mount 90 slides over the raised shoulder 92 of the body portion 12 and includes a channel 95 that accepts and engages with the ridge 97 of the body portion shoulder 92. Thus, the on-off seal mount 90 snap-fits onto the body portion 12 and holds the assembly together without the use of screws or bolts. That is, the parts are permanently held together by integral snap-fit means rather than by threaded fasteners, pins, or the like. This reduces the cost of materials and speeds up assembly. In addition, in-store vandalism, such as the removal of parts, is reduced.

The interior surface 102 of the seal support 100 includes a circular ridge 104. A pliable on-off seal 106 has a generally flat surface with a circular channel 108 that receives the ridge 104, thereby properly locating the seal 106 on the seal support 100. The on-off seal 106 includes a circular ridge 110 extending from the surface opposite the circular groove 108. The ridge 110 includes a curved surface 112 forming a cup having sloping outer walls 114. The slope of the outer walls 114 substantially matches the diagonal slant of the beveled rim 59 of the waterway.

When the trigger 18 is moved to a closed position, water pressure in the valve 10 pushes against the inner cup surface 112, forcing the sidewall 114 into tighter engagement with the beveled rim of the waterway 58. Thus, increasing the water pressure creates a more effective seal against leakage. When the trigger 18 is moved away from the on-off seal 106, an open space is created between the sidewall 114 of the seal and the beveled rim 59 of the waterway. The fluid can then flow through the waterway, between the seal 106 and the waterway rim 59, past the fingers 98, into the bowl of the seal mount 90, and out the selected openings in the cap 22, as shown in FIG. 2.

A curved flange or collar 118 extends from the outer surface of the cylindrical body portion 58 of the trigger 18 and has a diameter that allows it to fit within the area defined by the sidewall 72 of the rear seal retainer 70. A spring 120 is located in the space between the rear seal retainer 70 and the waterway flange 118. The spring 120 presses against the rear seal retainer 70 and the waterway flange 118 so as to bias the trigger 18 into the closed position. Thus, in moving from the closed position to the open position, the trigger 18 is subjected to substantially the spring force alone. The spring 120 is selected to have a spring force constant such that the force needed to operate the trigger 18 remains relatively constant or generally of same magnitude regardless of the water pressure in the body portion 12 and trigger waterway.

A spray nozzle cap 22 snaps onto the on-off seal mount 90. The outside circumference of the on-off seal mount rim 96 is provided with a raised edge or shoulder 24. The generally circular spray cap 22 has a lip 26 around its circumference that fits over the shoulder 24. The lip 26 presents a flat surface that engages against the shoulder 24 and prevents the cap 22 from sliding off the seal mount 90. The snap-fit of the cap 22 on the seal mount 90 allows the cap 22 to rotate on the seal mount 90. In this way, the cap 22 helps to hold the spray valve parts together without the use of pins, screws, or other screw-threaded fasteners that may require a tool for assembly. Both materials cost and assembly time are reduced by using such a threadless fastening arrangement.

Figure 5:
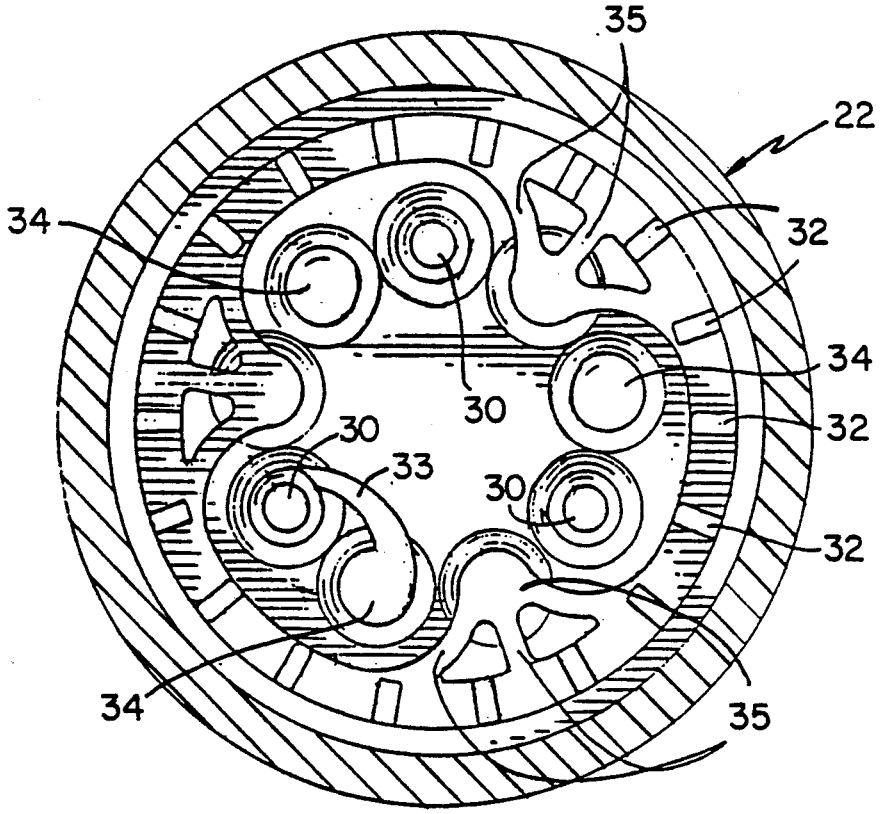
FIG. 5 is a perspective view of the inside surface of the spray cap in accordance with a preferred embodiment of the present invention.
Figure 6:
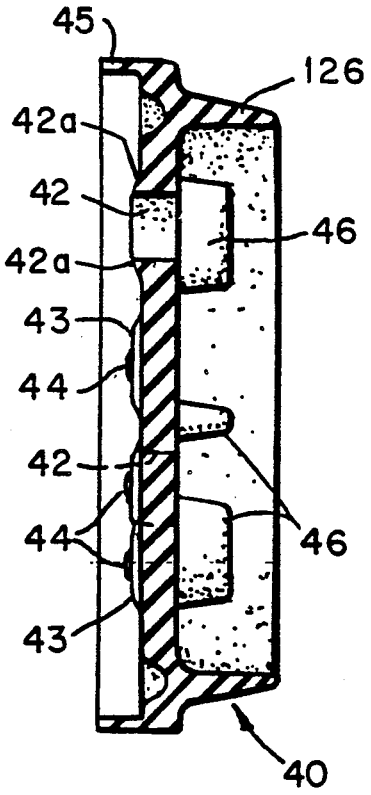
FIG. 6 is a cross-sectional view of the selector seal.

The cap 22, best seen in FIGS. 4 and 5, is provided with a plurality of openings, or orifices, on its outside surface. FIG. 4 shows a view of the cap exterior and illustrates that the orifices comprise two groups, from which each of the desired spray patterns emerges. A first group of orifices 30 comprises three openings located equidistant from the center of the cap 22 and spaced apart circumferentially. A second group of orifices 32 comprises a plurality of fine spray openings (eighteen are illustrated) having an opening area smaller than that of the first group of spray openings 30 and located further toward the circumference of the cap 22. Although only two "sets" of orifices are provided, a third spray pattern may be selected. A fine mist, useful for watering plants or whenever a more gentle spray is desired, emerges from one of the coarse spray openings 30. The presently preferred structure for generating the mist spray will be discussed further.

Each of the coarse spray orifices 30 comprises a straight bore between the outside and inside surfaces of the spray cap 22. Likewise, the fine spray openings 32 comprise straight bores through the cap 22. In order to achieve a fine spray, the openings 32 are provided with a smaller bore as compared to that of the coarse spray openings 30.

A generally disc-shaped selector seal 40 is placed on the seal support 100 of the on-off seal mount 90 and against the inside surface of the cap 22. The seal 40 preferably has a thin skirt 45 to aid in sealing. On its outward face adjacent the spray cap 22, the selector seal 40 includes at least one and, in the embodiment shown, three fluid holes 42 spaced apart circumferentially in a circle. The space between each of the three holes 42 on the selector seal 40 are taken by two protuberances 43, preferably domed, for a total of six protuberances 43 in the illustrated embodiment, arranged in a circle having a diameter equal to that of the circle defined by the three holes 42. Each of the protuberances 43 includes a raised nib 44 for better detenting action of the cap 22, as will be discussed further.

As noted previously, the inner surface of the cap 22, illustrated in FIG. 5, includes three bores 30. When a coarse spray is produced, fluid flows through the orifices 42 of the selector seal 40 and out the bores 30 in the cap 22.

The inner surface of the cap 22 also includes curved "ramps" 35 that distribute the fluid flow from the three orifices 42 of the selector seal 40 to the fine spray openings 32. The ramps 35 extend from the orifices 32 toward the center of the cap 22 and meet at three separate points located in a circle having a diameter equal to that of the circle defined by the three fluid holes 42. Fluid from the holes 42 is channeled from the three meeting points outwardly toward the circumference of the cap 22 and into the orifices 32. In this manner, a fine spray is produced.

Finally, located on the inner surface of the cap 22 within the circle defined by the selector seal fluid holes 42 and between the cap bores 30 and the ramps 35 are three preferably dome-shaped indentations 34. At least one of the dome-shaped indentations 34 includes a curved pathway 33 leading from the domed indentation 34 to one of the openings 30, which will now be referred to as a coarse/mist spray hole or bore. The curved pathway 33 communicates a with the coarse/mist spray bore 30 opening on the outside surface of the cap 22. The curved pathway 33 meets the dome-shaped indentation 34 at an angle tangent to the indentation 34 such that fluid enters the domed indentation 34 from the fluid hole 42 of the selector seal 40, spins in the dome 34 with great centrifugal velocity, and then flows in the curved pathway 33 and out the coarse/mist spray bore 30 on the outer surface of the cap 22 at a very high velocity so that a mist is produced. In this manner, at least one of the bores used to produce a coarse spray, i.e., a bore having a relatively large diameter, is used to produce a mist. This is extremely advantageous over the use of a small bore in that the potential for clogging is greatly reduced. The preferred embodiment uses a single bore to produce a fine, well-dispersed mist. However, plural bores may be used for mist production. In that case, plural bores are each connected by a curved pathway to an indentation on the spray cap.

Each of the fluid holes 42 of the selector seal 40 includes a ridge 42*a* extending from the surface of the selector seal 40. As the cap 22 is rotated to select a desired spray pattern, each of the domed protuberances 43 of the selector seal 40 and the ridge portions 42*a* of the fluid holes 42 seats into the openings 30, the meeting points of the ramps 35, and the dome-shaped indentations 34 of the cap 22. In order to provide better registration and detenting action between the cap 22 and selector seal 40, each of the protuberances 43 of the selector seal 40 includes an extending nib 44 that likewise seats into respectively one of the openings 30, the ramps 35, and the dome-shaped indentations 34. Thus, in the described embodiment, there are 9 adjacent detent positions, spaced 40° apart along the circumference of a circle. Three of the detent positions correspond to a coarse spray, three to a fine spray, and three to a mist.

Figure 7:
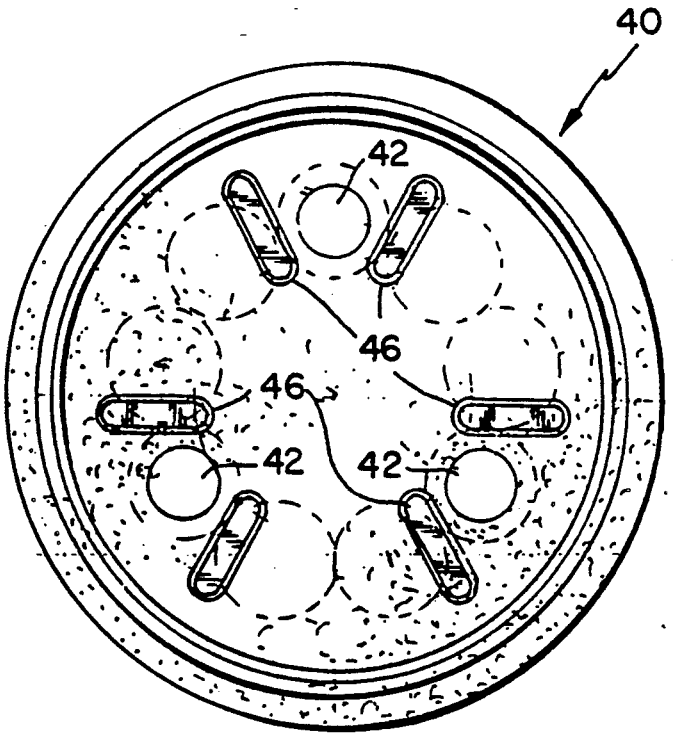
FIG. 7 is a plan view of the selector seal backside.

The back surface of the selector seal 40, illustrated in FIG. 7, includes the three holes 42 and a plurality of projecting tabs 46. The tabs 46 fit against the extending fingers 98 on the seal mount 90, thereby preventing movement of the selector seal 40 relative to the spray cap 22 and the seal mount 90. As best seen in FIG. 7, two of the projecting tabs 46 are located on opposite sides of each one of the fluid holes 42 in the selector seal 40. This provides for more rigidity and helps to channel the fluid flow more directly.

The selector seal 40 also includes a rim 126 extending from around the circumference of the selector seal 40. The extending rim seats against the inner surface of the rim 96 on the seal mount 90, and prevents the fluid flow from leaking between the seal mount 90 and cap 22.

Preferably, the rotating cap 22 and the seal mount 90 include indexing means for indicating when a set of openings in the cap 22 is aligned with a set of openings in the selector seal 40. The indexing means may, for example, comprise one or more raised projections 128 that project from the outside shoulder of the cap 22. In between the indexed positions of alignment, the openings are not aligned and fluid will not pass from the inlet opening 14 through the outlet opening 16 and cap 22. To prevent the cap 22 from rotating completely around on its axis, the inside rim of the cap 22 may be provided with two bump stops 25 that lodge against a raised ridge 41 on the rim of the selector seal 40. In this manner, the cap 22 is firmly locked and in exact registration in each of the different spray positions, and the seal members are properly aligned.

In operation, the body portion 12 is cradled between the thumb and forefinger of the user's hand. The fingers fall naturally to the curved handle portion 56 of the trigger 18, and are used to reciprocate the trigger between the fluid flowing position and the fluid blocking position. This provides a comfortable operating grip. Pulling back on the trigger 18, the user works against the force of the spring 120 to move the trigger 18 to the fluid flowing position. The constant actuating force and the comfortable operating grip provide a spray valve 10 that is easier and more comfortable to use.

One preferred embodiment of the present invention has been described. Nevertheless, it will be understood that various modifications may be made without departing from the spirit and scope of the invention. For example, the selector seal 40 may be made without the protuberances 43, i.e., flat. Also, the selector seal 40 may be made without the skirt 45. Additionally, plural bores in the spray cap may be used for mist production. Accordingly, it is to be understood that the invention is not to be limited by the specific illustrated embodiment, but only by the scope of the appended claims.

What is claimed is:

1. A spray valve for controlling and directing the flow of a fluid, comprising:

a body member having an inlet opening and an outlet opening;

sealing means for controlling the flow of the fluid from the inlet opening to the outlet opening and including a plurality of orifices through which the fluid may pass, a fluid seal having an outer sidewall and an inner cup-shaped surface, and a trigger having a hollow waterway with a rim and having walls of reduced thickness, the waterway being movable between a closed position and an open position such that the walls of reduced thickness present minimal surface area perpendicular to the fluid flowing from the inlet opening to the outlet opening so that force required to move the waterway between the two positions remains generally of the same magnitude regardless of water pressure in the body member and waterway, and when in the closed position, the outer sidewall engages the rim of the waterway such that pressure of the fluid in the waterway pushes against the inner cup-shaped surface forcing the outer sidewall to effectively seal one end of the waterway so that the waterway is obstructed and the flow of the fluid from the inlet opening through the outlet opening is prevented, and in the open position the waterway is moved away from the fluid seal to enable the flow of the fluid;

biasing means for normally biasing the trigger in the closed position; and a spray valve cap having a plurality of orifices communicating between the outside surface of the cap and the inside surface of the cap and being attached to the body member over the outlet opening such that at least one of the orifices in the inside surface of the cap may be aligned with at least one of the orifices in the fluid sealing means, thereby allowing fluid to pass through the outlet opening and selecting a spray pattern for the fluid.

2. A spray valve for controlling and directing the flow of a fluid, comprising:

a body member having an inlet opening and an outlet opening;

sealing means for controlling the flow of the fluid from the inlet opening to the outlet opening and including a fluid seal having an outer sidewall and an inner cup-shaped surface, and a trigger having a hollow waterway with a rim and having walls of reduced thickness, the waterway being movable between a closed position and an open position such that the walls of reduced thickness present minimal surface area perpendicular to the fluid flowing from the inlet opening to the outlet opening so that force required to move the waterway between the two positions remains generally of the same magnitude regardless of water pressure in the body member and waterway, and when in the closed position, the outer sidewall engages the rim of the waterway such that pressure of the fluid in the waterway pushes against the inner cup-shaped surface forcing the outer sidewall to effectively seal one end of the waterway so that the waterway is obstructed and the flow of the fluid from the inlet opening through the outlet opening is prevented, and in the open position the waterway is moved away from the fluid seal to enable the flow of the fluid; and biasing means for normally biasing the trigger in the closed position;

wherein the closed position, the pressure of the fluid in the waterway pushes against the fluid seal thereby forcing the sidewall of the fluid seal into tighter engagement with the rim of the waterway to that an increase in fluid pressure creates a tighter seal at the outlet opening;

wherein the spray valve is assembled entirely with threadless fastening means comprising an integral snap-fit construction for holding the spray valve body member, sealing means, and biasing means in the relative positions required for proper operation.

3. A spray valve for controlling and directing the flow of a fluid, comprising:

a body member having an inlet opening and an outlet opening;

sealing means for controlling the flow of the fluid from the inlet opening to the outlet opening and including a plurality of orifices through which the fluid may pass, a fluid seal having an outer sidewall and an inner cup.shaped surface, and a trigger having a hollow waterway with a rim and having walls of reduced thickness, the waterway being movable between a closed position and an open position such that the walls of reduced thickness present minimal surface area perpendicular to the fluid flowing from the inlet opening to the outlet opening so that force required to move the waterway between the two positions remains generally of the same magnitude regardless of water pressure in the body member and waterway, and when, in the closed position, the fluid seal outer sidewall engages the rim of the waterway such so that pressure of the fluid in the waterway pushes against the inner cup-shaped surface forcing the outer sidewall to effectively seal one end of the waterway so that the waterway is obstructed and the flow of the fluid from the inlet opening through the outlet opening is prevented, and in the open position the waterway is moved away from the fluid seal to enable the flow of the fluid;

biasing means for normally biasing the trigger in the closed position; and a spray valve cap having a plurality of orifices communicating between the outside surface of the cap and the inside surface of the cap and being attached to the body member over the outlet opening such that at least one of the orifices in the inside surface of the cap may be aligned with at least one of the orifices in the fluid sealing means, thereby allowing fluid to pass through the outlet opening and selecting a spray pattern for the fluid;

wherein the spray valve cap is attached to the body member by an integral snap-fit arrangement comprising a raised lip on the valve cap circumference and a shoulder at the body member outlet opening over which snaps the lip of the spray valve cap.

4. A spray valve for controlling and directing the flow of a fluid, comprising:

a body member having an inlet opening and an outlet opening;

sealing means for controlling the flow of the fluid from the inlet opening is the outlet opening and including a plurality of orifices through which the fluid may pass, a fluid seal having an outer sidewall and an inner cup-shaped surface, and a trigger having a hollow waterway with a rim and having walls of reduced thickness, the waterway being movable between a closed position and an open position such that the walls of reduced thickness present minimal surface area perpendicular to the fluid flowing from the inlet opening to the outlet opening so that force required to move the waterway between the two positions remains generally of the same magnitude regardless of water pressure in the body member and waterway, and when in the closed position, the outer sidewall engages the rim of the waterway such that pressure of the fluid in the waterway pushes against the inner cup-shaped surface forcing the outer sidewall to effectively seal one end of the waterway so that the waterway is obstructed and the flow of the fluid from the inlet opening through the outlet opening is prevented, and in the open position the waterway is moved away from the fluid seal to enable the flow of the fluid;

biasing means for normally biasing the trigger in the closed position;

a spray valve cap having a plurality of orifices, communicating between the outside surface of the cap and the inside surface of the cap and being attached to the body member over the outlet openings such that at least one of the orifices in the inside surface of the cap may be aligned with at least one of the orifices in the fluid sealing means, thereby allowing fluid to pass through the outlet opening and selecting a spray pattern for the fluid;

wherein the spray valve cap includes at least one chamber communicating with one of the orifices in the outside surface of the cap.

5. A spray valve for controlling and directing flow of a fluid, comprising:

a body member having an inlet opening and an outlet opening;

flow means for directing the flow of fluid in the body member from the inlet opening to the outlet opening, having an opened position which allows the fluid to flow and a closed position which prevents the flow of the fluid;

select means for designating a spray type, the select means having at least one fluid hole therethrough; and a spray cap adjacent the select means, having an outer surface and an inner surface, the inner surface having at least one indentation formed therein, and at least one course/mist spray hole therethrough, each said at least one coarse/mist spray hole having a diameter sufficiently large for producing a coarse spray, and wherein a spiral path connects said at least one indentation and said at least one coarse/-mist spray hole;

wherein when the flow means is in an opened position and said at least one a fluid hole in the select means is aligned with said at least one indentation in the spray cap, the fluid flows through the fluid hole to the indentation, through the spiral path, and out said at least one coarse/mist spray hole in the spray cap at high velocity so that substantially a mist is produced, and when the flow means is in an opened position and said at least one fluid hole is aligned with said at least one coarse/mist spray hole, the fluid flows through the fluid hole and out said at least one coarse/mist spray hole so that substantially a coarse spray is produced.

6. A spray cap for use with a spray valve to produce a mist, comprising:

a body member having at least one coarse/mist spray hole therethrough and at least one indentation on an inner surface thereof, said at least one coarse/-mist spray hole having a diameter sufficiently large for producing a coarse spray, wherein at least one of the coarse/mist spray holes and one of the indentations are connected by a spiral path, the spiral path having a larger cross sectional area where it meets the indentation and a smaller cross-sectional area where it meets said at least one coarse/mist spray hole, and further including means for selectively selecting whether fluid entering the spray cap flows to the indentation, through the spiral path, and out said at least one coarse/mist spray hole so as to substantially produce the mist, or whether the fluid entering the spray cap flows to said at least one coarse/mist spray hole without flowing to the indentation so as to substantially produce a coarse spray.

7. A spray valve for controlling and directing the flow of a fluid, the spray valve producing a coarse spray from at least one hole in a spray cap, the same hole also being used to produce a mist comprising:

a body member having an inlet opening and an outlet opening;

flow means for directing the flow of fluid in the body member from the inlet opening to the outlet opening, having an opened position which allows the flow of fluid and a closed position which prevents the flow of fluid;

select means for designating a spray type, the select means being in flow communication with the flow means and having a fluid hole and a protuberance; and a spray cap adjacent the select means, having an outer surface and an inner surface, the inner surface having an indentation formed therein, and a coarse/-mist spray hole therethrough having a diameter sufficiently large for producing a coarse spray, wherein a spiral path connects the indentation and the coarse/mist spray hole;

wherein when the flow means is in an opened position and the protuberance in the select means is aligned with the indentation in the spray cap and the fluid hole in the select means is aligned with the coarse/-mist spray hole in the spray cap, fluid flows through the fluid hole in the select means and exits the coarse/mist spray hole in the spray cap so as to substantially produce a coarse spray; and wherein when the flow means is in an opened position and the fluid hole in the select means is aligned with the indentation in the spray cap, fluid flows through the fluid hole in the select means to the indentation in the spray cap, through the spiral path, and out the coarse/mist spray hole in the spray cap at high velocity so that substantially a mist is produced.

8. A spray valve for controlling and directing the flow of a fluid, comprising:

a valve body having an inlet opening and an outlet opening;

a trigger slidably received in the valve body and having a cylindrical body defining a hollow waterway having a rim and being open at both ends for passage of the fluid such that the fluid may flow from the inlet opening through the trigger waterway and to the outlet opening;

a trigger seal having an outer sidewall, an inner cup shaped surface and being within the valve body so that the trigger may slide to engage the outer sidewall with the rim so as to allow pressure of the fluid in the waterway to push against the inner cup shaped surface forcing the sidewall to effectively seal and close off one end of the waterway, thereby preventing the flow of the fluid, or said trigger may be moved away from the trigger seal, thereby enabling the flow of the fluid; and a seal mount attached to the valve body at the outlet opening, having an inside surface facing into the outlet opening and having an outside surface, and having a plurality of orifices passing from the inside surface to the outside surface.

9. A spray valve for controlling and directing the flow of a fluid, comprising:

a body member having an inlet opening and an outlet opening;

sealing means for controlling the flow of the fluid from the inlet opening to the outlet opening including a fluid seal having an outer sidewall and an inner cup-shaped surface;

flow means for directing the flow of the fluid in the body member from the inlet opening to the outlet opening, said flow means including a cylindrical body having a rim at one end and defining a waterway and reciprocating within the body member;

flow control means for moving the cylindrical body between a first position that allows the fluid to flow and a second position in which the outer sidewall engages the rim so that pressure of the fluid in the waterway pushes against the inner cup-shaped surface forcing the outer sidewall to effectively seal one end of the waterway so as to that prevent the flow of the fluid; and spray selector means for defining a plurality of fluid spray patterns issuing from the fluid flow at the outlet opening.

10. A spray valve for controlling and directing the flow of a fluid, comprising:

a body member having an inlet opening and an outlet opening;

sealing means for controlling the flow of the fluid from the inlet opening to the outlet opening including a fluid seal having an outer sidewall and an inner cup.shaped surface;

flow means for directing the flow of the fluid in the body member from the inlet opening to the outlet opening, said flow means including a cylindrical body having a rim at one end and defining a waterway and reciprocating with the body member;

flow control means for moving the cylindrical body between a first position that allows the fluid to flow and a second position in which the outer sidewall engages the rim so that pressure of the fluid in the waterway pushes against the inner cup-shaped surface forcing the outer sidewall to effectively seal one end of the waterway so as to that prevent the flow of the fluid; and spray selector means for defining a plurality of fluid spray patterns issuing from the fluid flow at the outlet opening;

wherein said spray selector means alternately selects between each of the fluid spray patterns.

11. A method for producing a mist with a spray valve comprising a body member having an inlet opening and an outlet opening, flow means for directing the flow of fluid in the body member from the inlet opening to the outlet opening, the flow means having an opened position which allows the flow of fluid and a closed position which prevents the flow of fluid, select means for designating a spray type, the select means being in flow communication with the flow means and having a fluid hole therethrough and a protuberance on an outer surface thereof, and a spray cap having an inner surface having an indentation, a hole therethrough, and a spiral path connecting the hole with the indentation, the hole being sized so as to produce a jet of said fluid or a coarse spray when the hole in the select means is aligned with the hole in the spray cap and the protuberance in the select means is aligned with the indentation in the spray cap, comprising the steps of:

aligning the hole in the select means with the indentation in the spray cap so that fluid flows from the hole to the indentation; and increasing the velocity of the fluid as it flows from the indentation through the spiral path to the hole in the spray cap so that when the fluid exits the hole in the spray cap, a mist is produced.

12. A method for producing a mist as in claim 11 wherein the velocity of the fluid is increased by directing the fluid through a spiral pathway as it leaves the hole in the select means, the spiral pathway having a larger cross-sectional area at the end at which the fluid enters and a smaller cross-sectional area at the end at which the fluid exits the spiral pathway and enters the hole in the spray cap.

13. A method for producing a mist from a relatively slow stream of fluid in a spray valve, comprising the steps of:

directing the stream of fluid into a dome wherein the fluid spins at high centrifugal velocity;

directing the fluid through a spiral pathway, the spiral pathway having a larger diameter at an end at which the fluid enters the spiral pathway and a smaller diameter at an end at which the fluid exists the spiral pathway; and directing the high velocity stream of fluid from the spiral pathway through a hole having sharp edges so that a mist is produced, said hole having a diameter sufficiently large for producing a coarse spray when fluid flows directly through the hole without entering the spiral pathway.

* * * * *